US007171909B2

(12) United States Patent
Alt

(10) Patent No.: US 7,171,909 B2
(45) Date of Patent: Feb. 6, 2007

(54) ADJUSTABLE DISPLAY RACK

(75) Inventor: Steven J Alt, Grand Rapids, MI (US)

(73) Assignee: TADD Industries, Inc., Marne, MI (US)

( * ) Notice: Subject to any disclaimer, the term of this patent is extended or adjusted under 35 U.S.C. 154(b) by 394 days.

(21) Appl. No.: 10/797,295

(22) Filed: Mar. 10, 2004

(65) Prior Publication Data

US 2004/0178159 A1 Sep. 16, 2004

Related U.S. Application Data

(60) Provisional application No. 60/454,147, filed on Mar. 12, 2003.

(51) Int. Cl.
*A47F 5/12* (2006.01)

(52) U.S. Cl. ..... 108/7

(58) Field of Classification Search ..... 108/99, 108/92, 100, 3, 7, 108, 66; 211/149, 150, 211/130.1, 132.1, 208, 36, 38, 133.1, 175, 211/198, 199

See application file for complete search history.

(56) References Cited

U.S. PATENT DOCUMENTS

| | | | | | |
|---|---|---|---|---|---|
| 444,663 | A | * | 1/1891 | Collier | 108/7 |
| 940,807 | A | | 11/1909 | Hart | |
| 1,171,523 | A | * | 2/1916 | Kuhn | 108/7 |
| 1,231,713 | A | | 7/1917 | Cummings | |
| 2,162,298 | A | * | 6/1939 | Dailey | 108/66 |
| 2,184,976 | A | * | 12/1939 | McFall | 108/63 |
| 4,836,114 | A | * | 6/1989 | Cohen et al. | 108/77 |
| 5,074,513 | A | | 12/1991 | Presley et al. | |
| 5,107,774 | A | | 4/1992 | Allen | |
| 5,197,393 | A | | 3/1993 | Yeakle | |
| 5,344,033 | A | | 9/1994 | Herman | |
| 5,590,796 | A | | 1/1997 | Herman | |
| 5,730,068 | A | | 3/1998 | Rioux, Jr. | |
| 5,791,500 | A | | 8/1998 | Burke et al. | |
| 6,321,663 | B1 | | 11/2001 | Rogers | |
| 2002/0023889 | A1 | | 2/2002 | Larbaletier | |

* cited by examiner

*Primary Examiner*—Jose V. Chen
(74) *Attorney, Agent, or Firm*—VanDyke, Gardner, Linn & Burkhart, LLP

(57) ABSTRACT

An adjustable display rack or stand for displaying products on at least two panels of the display rack. The panels being adjustable about respective generally horizontal pivot axes to adjust an angle or degree of tilt of the panels relative to a base of the display rack. The panels are substantially simultaneously or correspondingly pivoted via an adjustable mechanism and at least one cable connected to the adjustable mechanism and at least one of the panels. The adjustable mechanism may be connected to one of the panels via the cable and may be coupled to one other of the panels, whereby the panels are pivotable via movement of the adjustable mechanism. The adjustable mechanism may comprise a threaded collar that is threadedly coupled to an elongated threaded shaft such that rotation of the shaft causes movement of the collar along the shaft to pivot the panels about their pivot axes.

25 Claims, 7 Drawing Sheets

ADJUSTABLE DISPLAY RACK

CROSS REFERENCE TO RELATED APPLICATION

The present application claims the benefit of U.S. provisional application, Ser. No. 60/454,147, filed Mar. 12, 2003, which is hereby incorporated herein by reference in its entirety.

FIELD OF THE INVENTION

The present invention relates generally to display racks or stands and, more particularly, to display racks used to display produce in grocery stores and retail environments wherein the display rack has adjustable or pivotable shelving.

BACKGROUND OF THE INVENTION

Produce display stands in grocery stores and other retail environments often display the produce in an island-type display. That is, the display generally defines an island about which customers can completely circumnavigate. The island is often constructed so that the surfaces on which the produce are placed are angled upwardly away from the customer. This angling of the products allows the customers to better see the produce positioned thereon. Depending on the type of produce, packages, or other items positioned on the display, it may be desirable to adjust the angle of the panel on which the goods are positioned. With conventional display racks, this adjustment of the storage surfaces is often a time consuming task. For example, known mechanisms for adjusting the angle of the storage surfaces may include the use of conventional automobile jacks typically used to raise and lower automobiles. The use of such jacks, however, is often undesirable because the jacks are geared to create minimal height adjustment with large amounts of cranking. It therefore requires a great deal of effort to raise or lower the display storage platforms a relatively small distance. Adjusting the storage platforms a relatively large distance requires even more time and effort. Also, the conventional jacks are normally not part of the display rack and are thus often misplaced or must be handled separately when the display rack is relocated to another location within the store.

The desire can therefore be seen for an adjustable display stand for displaying produce or other similar items which can be more easily adjusted.

SUMMARY OF THE INVENTION

The present invention provides an improved adjustable display stand that is both economical to manufacture and easy to use. The adjustable display stand of the present invention includes an adjustment mechanism that is operable to substantially simultaneously or correspondingly pivot at least two panels of the display stand between a lowered or generally horizontal position and a raised or tilted position. The face of the panels thus may be adjusted to a desired angle or degree of tilt to provide a desired display of the goods or products placed on the display stand.

According to an aspect of the present invention, an adjustable display stand is provided that includes a base, first and second panels, and a height adjustment mechanism. The first and second panels have opposite ends, one of which is pivotally mounted to the base such that the panel is pivotable about a generally horizontal pivot axis. The height adjustment mechanism is adapted to pivot the panels substantially simultaneously about their pivot axes such that the height of the free ends of the panels can be adjusted relative to the base. The height adjustment mechanism includes at least one cable attached to the panels and movable around at least one pulley attached to the base. The height adjustment mechanism is adapted to move the cable or cables to change the heights of the free ends of the panels.

According to other aspects of the present invention, the base of the display stand may include a plurality of wheels that are adapted to allow the stand to be rolled on the floor. The panels may be shaped to taper from the pivot end toward their free end. The height adjustment mechanism may include an elongated threaded shaft and a collar coupled to the shaft whereby rotation of the shaft causes the collar to change position with respect to the shaft. The cable or cables is/are attached to the collar, such that movement of the collar causes a corresponding movement of the cable or cables. A crank may also be added to the display stand and coupled to the shaft of the height adjustment mechanism whereby rotation of the crank causes the pivoting of the panels. Optionally, the stand may further include a third panel that is pivotably mounted to the base. Each of the three panels may be pivotable about horizontal axes that are generally coplanar and angled approximately 90 degrees with respect to each other.

Therefore, the present invention provides an adjustable display stand that is adjustable to correspondingly or substantially simultaneously adjust the degree of tilt of two or more panels via one or more cables and pulleys. The panels of the display stand may each be pivotable about a generally horizontal pivot axis at the base of the display stand and may pivot between a generally horizontal position, where the opposed edges of the panels are generally parallel to and adjacent to one another, and an upwardly angled or tilted position for displaying products or goods thereon. The arrangement of the pulleys and cables of the height adjustment mechanism allows the height of the panels to be easily adjusted with minimal effort, and to be firmly retained in whatever position they are ultimately adjusted to.

These and other objects, advantages, purposes and features of the present invention will be apparent to one skilled in the art upon review of the following specification in conjunction with the accompanying drawings.

DESCRIPTION OF THE PREFERRED EMBODIMENTS

Figure 1:
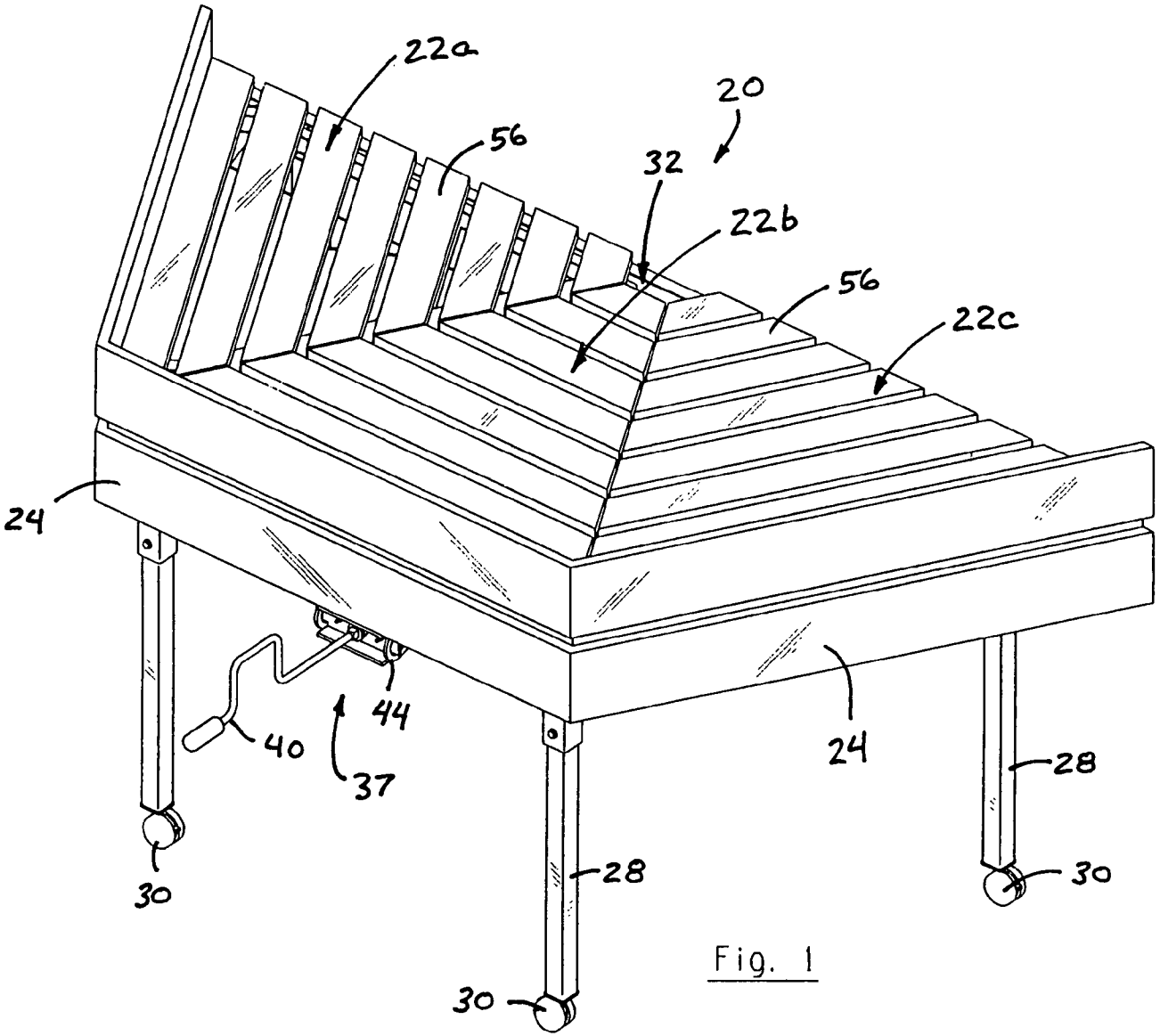
FIG. 1 is a perspective view of an adjustable display stand according to one embodiment of the present invention depicted with three panels in a generally horizontal position.
Figure 2:
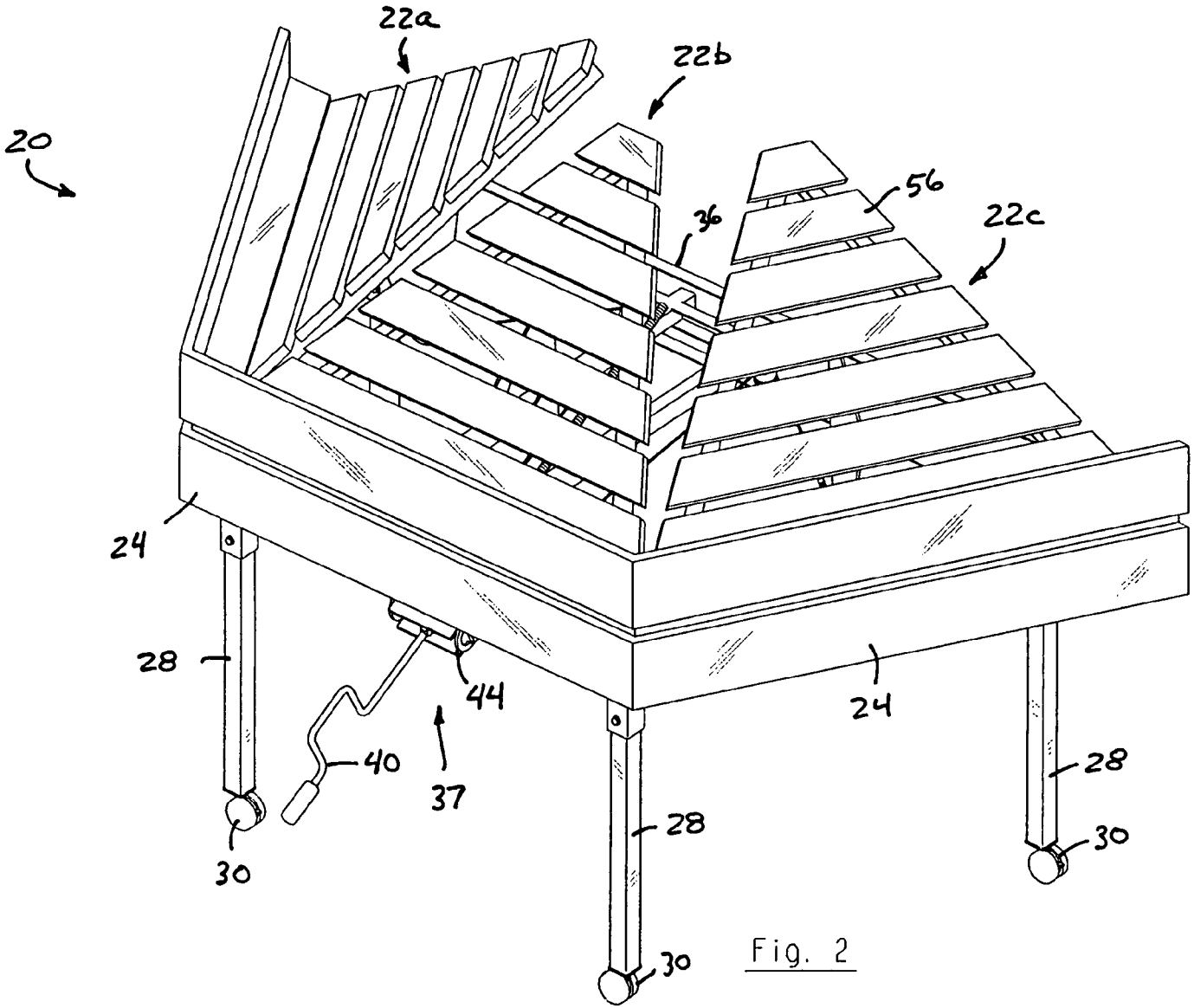
FIG. 2 is a perspective view similar to FIG. 1, with the three panels pivoted upwardly from the horizontal position.
Figure 3:
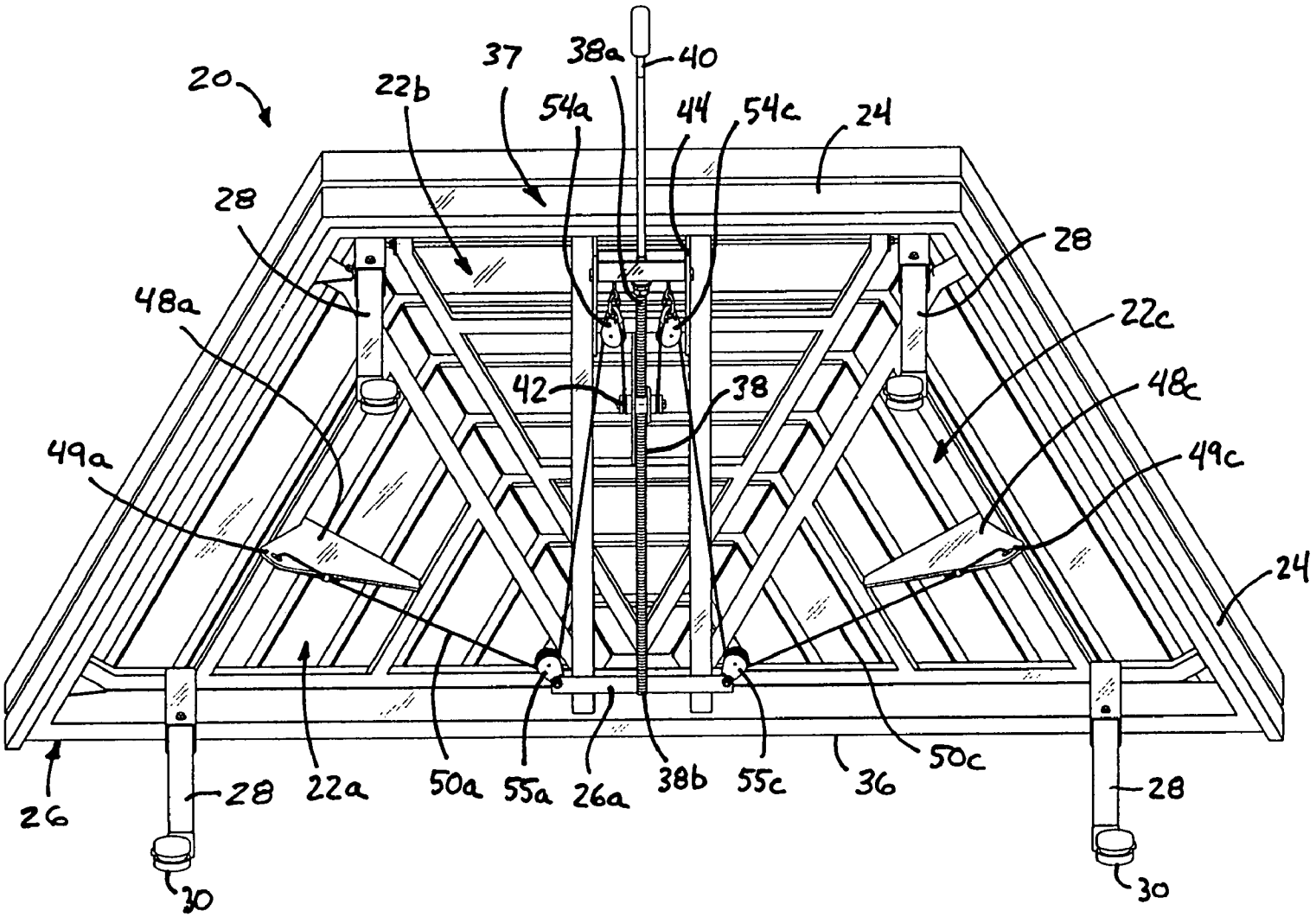
FIG. 3 is a perspective view of the underside of the adjustable display stand, with the panels in their generally horizontal position.
Figure 4:
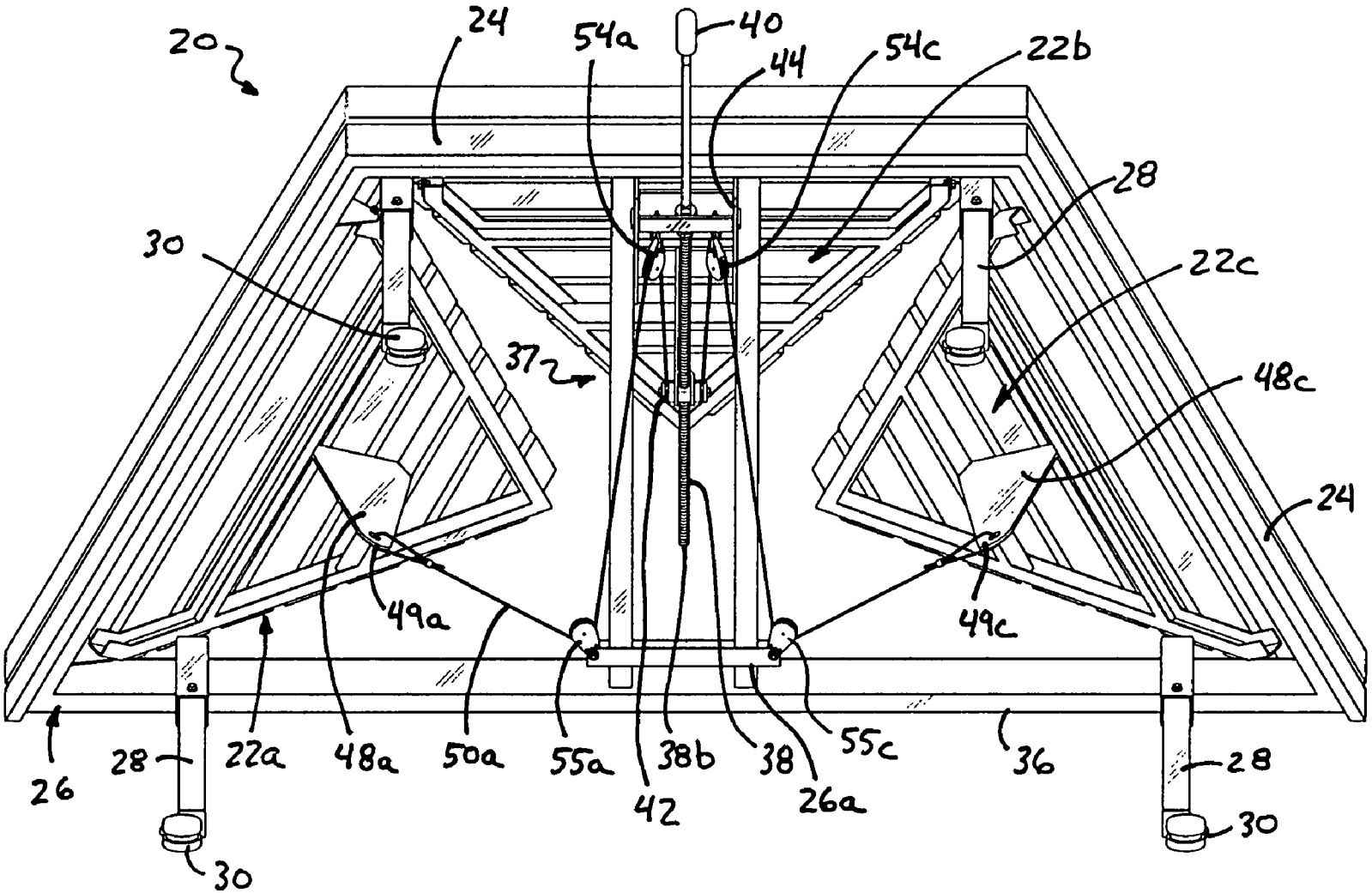
FIG. 4 is a perspective view of the underside of the adjustable display stand, with the panels in their pivoted or inclined position.

The present invention will now be described with reference to the accompanying drawings wherein the reference numbers in the description below correspond to like numbered elements in the accompanying drawings. A display stand or rack or end cap 20 according to one embodiment of the present invention is depicted in FIGS. 1–7. Display stand 20 includes three pivotable panels 22*a*, 22*b*, and 22*c*. Pivotable panels 22*a*–*c* are used to support retail items for sale, such as produce, or similar items. The pivotable panels 22*a*–*c* may be pivoted or adjusted between a generally horizontal orientation (as shown in FIGS. 1 and 3) and an upward or inclined position (as shown in FIGS. 2 and 4), as discussed below.

Display stand 20 is ideally suited to be positioned at one end of a display island. Accordingly, display stand 20 includes a skirt 24 that extends along three of the four sides of display stand 20. The fourth side 36 (FIGS. 3–5) of display stand 20 is generally straight or flat and may not include the skirt. The fourth or rear side 36 is intended to abut against another portion of the display island, and may abut against a corresponding side of another display stand, or may abut against a wall of the store or the like. In the illustrated embodiment, pivotable panels 22*a*–*c* are made up of a plurality of parallel boards 56, but may comprise other members or panels or the like, without affecting the scope of the present invention. Optionally, a cloth, sheet, or rigid material may be positioned over pivotable panels 22 before retail items are positioned thereon.

Display stand 20 generally includes a base 26 (FIGS. 3–7) to which panels 22*a*–*c* are pivotally mounted. Base 26 may include a plurality of legs 28 having wheels 30 mounted thereon. Wheels 30 allow display stand 20 to be easily moved to different locations. Wheels 30 may be caster type wheels or other types of wheels. Base 26 is preferably made of a steel framework, although other types of materials may be used within the scope of the present invention.

Figure 5:
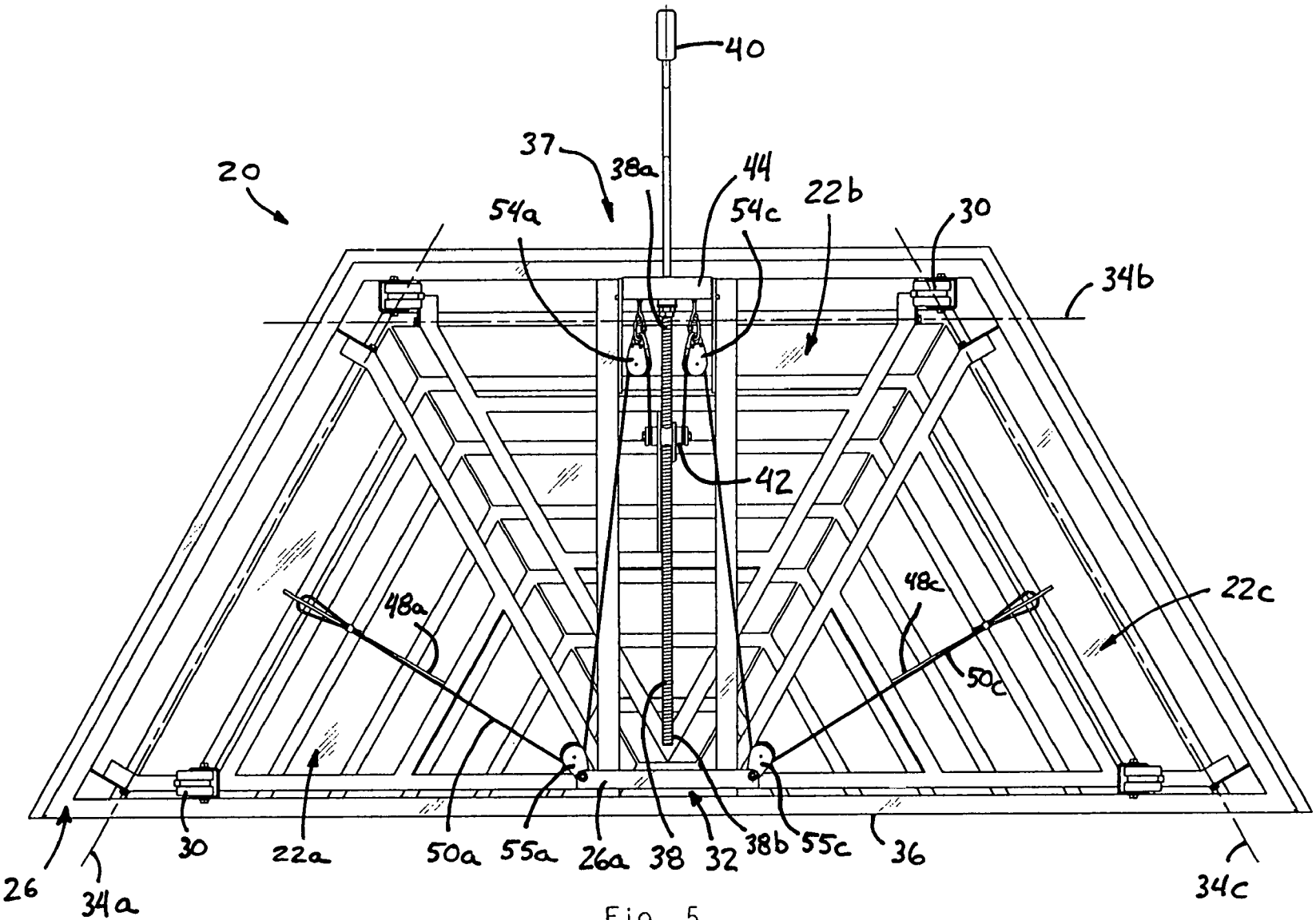
FIG. 5 is an underside plan view of the adjustable display stand of FIGS. 1–4.
Figure 6:
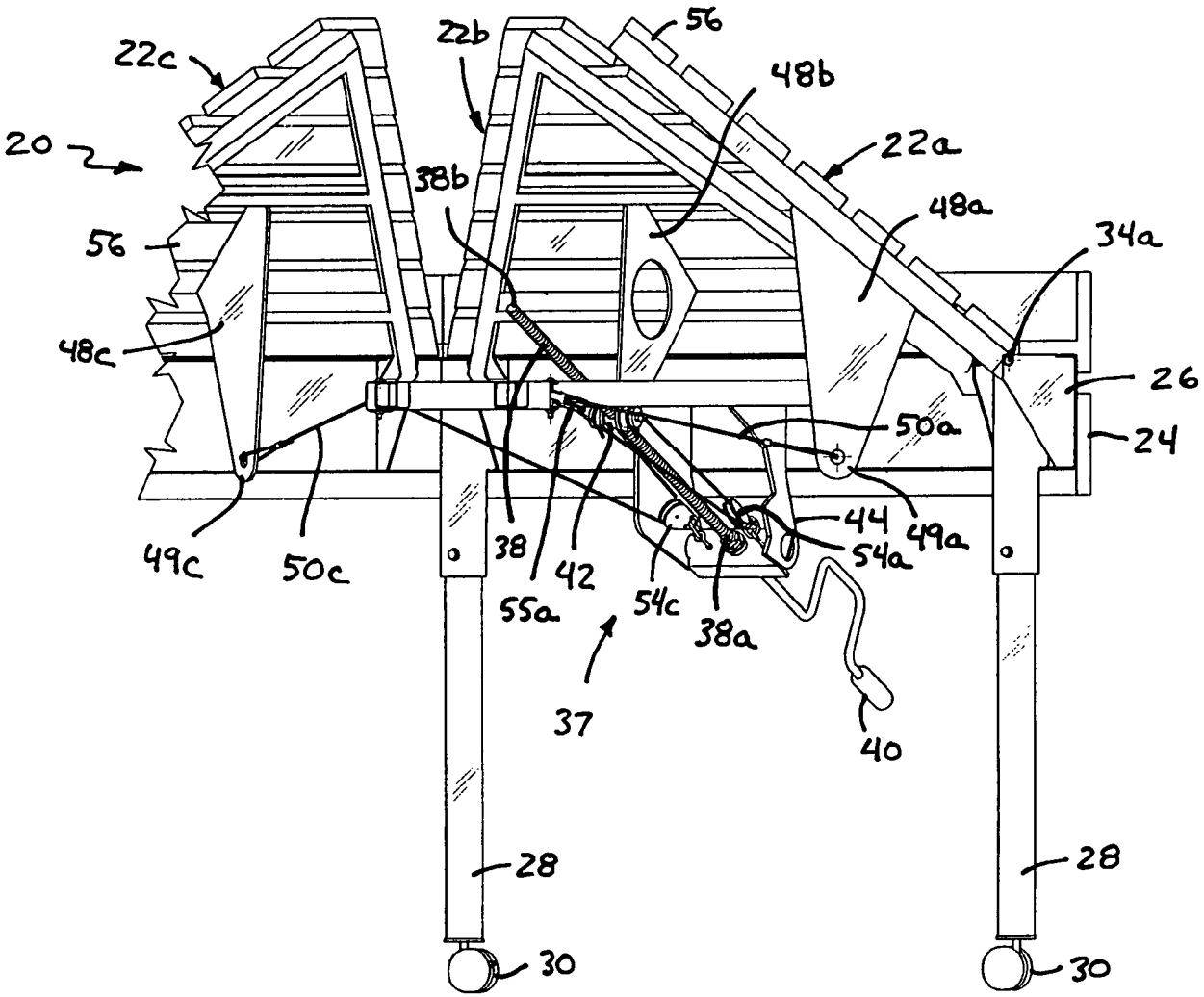
FIG. 6 is a side elevation of the adjustable display stand in the inclined orientation of FIGS. 2 and 4, as viewed along the pivot axis of one of the side panels of the display stand.
Figure 7:
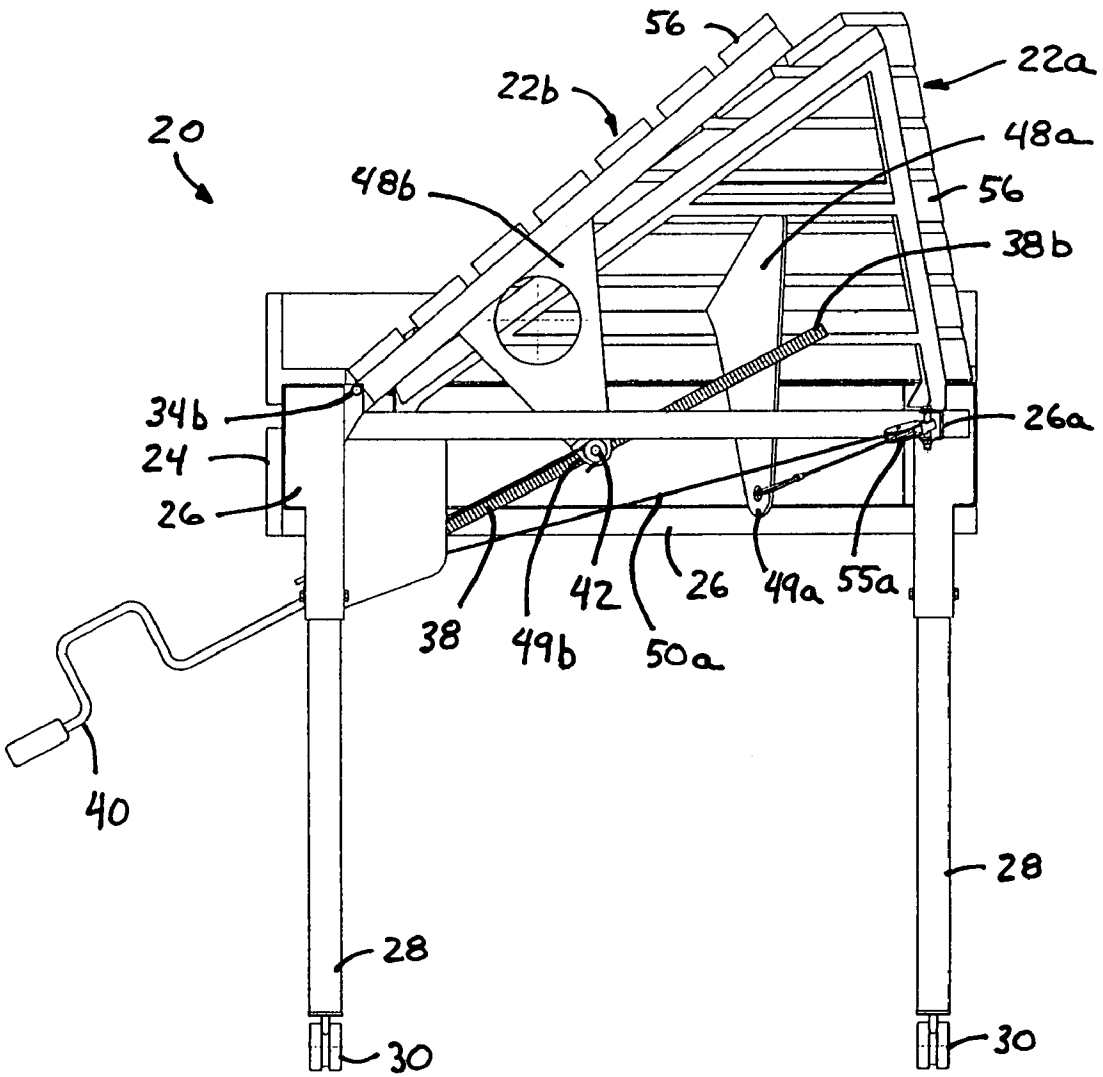
FIG. 7 is a sectional view of the adjustable display stand in the inclined orientation, as viewed along the pivot axis of the center panel of the display stand.

Each panel 22*a*, 22*b*, 22*c* in the illustrated embodiment is shaped generally like a triangle. An apex of each of the panels terminates in a center area 32 (FIG. 1) when the panels are generally in the horizontal orientation. The side of each panel opposite this apex is the side to which the panel is pivotally attached to base 26. Specifically, each panel 22*a*, 22*b*, 22*c* is pivotable about a respective horizontal pivot axis 34*a*, 34*b*, 34*c* (FIG. 5). Each of these pivot axes 34*a*–*c* are preferably co-planar and may be oriented at about sixty degrees with respect to each other (such as shown in the illustrated embodiment). Because there are three of these pivotable panels that may be angled at approximately sixty degrees with respect to each other, the entire display stand 20 may generally define half of a hexagon, with the flat or rear side 36. As discussed above, flat side 36 has no skirt and is preferably pushed up against the remaining portion of an island display stand or up against a wall or the like. Although shown and described as having three pivotable panels arranged at sixty degrees relative to one another, the display stand may include more or less than three panels and may have the panels arranged relative to one another at an angle that is greater or less than sixty degrees, without affecting the scope of the present invention.

Each of the panels 22*a*–*c* are pivotable about their respective pivot axes 34 by way of a height adjustment mechanism 37. The height adjustment mechanism 37 generally includes a rotatable, elongated threaded shaft 38. Threaded shaft 38 is rotatably mounted on base 26 and may be adapted to receive a crank or handle 40. In the illustrated embodiment, shaft 38 is rotatably mounted to a bracket 44 that extends generally downwardly from base 26 such that a lower end 38*a* of shaft 38 may be accessible from outside of the display stand and generally beneath the level of the base, as shown in FIGS. 1, 2, 6 and 7. When attached, crank or handle 40 causes threaded shaft 38 to rotate about its longitudinal axis when the crank or handle is rotated.

Height adjustment mechanism 37 further includes a fastener or collar 42, such as a female fastener or nut, that is threadably coupled to shaft 38. Collar 42 includes a circular aperture which is internally threaded and matingly receives the threads on shaft 38. Rotation of shaft 38 causes collar 42 to move longitudinally along the length of shaft 38 either towards a first end 38*a* or a second end 38*b*. The end towards which collar 42 moves when shaft 38 is rotated depends upon the direction of rotation of shaft 38. In the illustrated embodiment, movement of collar 42 towards second end 38*b* causes the panels 22*a*–*c* to pivot upwardly, while movement of collar towards first end 38*a* allows the panels 22*a*–*c* to pivot downwardly towards their horizontal position, as discussed below. As can be seen with reference to FIGS. 3 and 4, shaft 38 may be pivotally mounted to bracket 44 and may be pivoted upwardly when the shaft is rotated to move collar 42 toward second end 38*b* to raise or pivot the panels upwardly.

Adjustment mechanism 37 is coupled to extension plates or members 48*a*, 48*b*, 48*c*, which extend generally downward from the respective pivotable panels 22*a*, 22*b*, 22*c*. Adjustment mechanism 37 may be coupled to the extension plates via one or more cables and/or the collar 42 may be directly coupled to one of the extension plates. In the illustrated embodiment, collar 42 is coupled to a vertical extension plate 48*b* that is attached to the underside of middle panel 22*b*. Extension plate 48*b* extends generally downward from panel 22*b*, with a distal or lower end 49*b* of extension plate 48*b* rotatably coupled to collar 42. Extension plate 48*b* may be positioned at middle panel 22*b* such that the generally translational movement of the end 49*b* of the extension plate 48*b* causes pivotal movement of the panel 22*b* about its pivot axis 34*b*.

In the illustrated embodiment, first end 38*a* of shaft 38 is positioned at a lower height than second end 38*b* of shaft 38. Because shaft 38 is positioned on display stand 20 such that it is angled upwardly from first end 38*a* towards second end 38*b*, the movement of collar 42 along shaft 38 causes the end 49*b* of extension plate 48*b* to translationally move either upwardly or downwardly, depending upon the direction of rotation of threaded shaft 38. Movement of collar 42 toward second end 38*b* therefore causes collar 42 to move upwardly along shaft 38. As collar 42 moves along shaft 38 toward second end 38*b* and the panels are pivoted accordingly, shaft 38 may also pivot at bracket 44 such that second end 38*b* also moves upwardly. This upward and outward movement of collar 42 is translated to the end of extension plate 48*b*, which, in turn, causes middle panel 22*b* to pivot toward its angled or inclined position. Movement of collar 42 towards second end 38*b* thus causes pivotable panel 22*b* to pivot upwardly about its pivot axis 34*b*, while movement of collar 42 towards first end 38*a* of shaft 38 causes pivotable panel 22*b* to move or pivot downwardly for the same reasons discussed herein.

In the illustrated embodiment, collar 42 of adjustment mechanism 37 is also connected to two cables 50*a* and 50*c*. Cable 50*a* extends from collar 42 to extension plate 48*a* that is attached to the underside of pivotable panel 22*a*, while cable 50*c* extends from collar 42 to extension plate 48*c* that is attached to the underside of pivotable panel 22*c*. Cable 50*a* extends from collar 42 through a first pulley 54*a* and then back through a second pulley 55*a* before being attached to the bottom end of extension plate 48*a*. Similarly, cable 50*c* extends through a first pulley 54*c* and then through a second pulley 55*c* before being attached to the underside of extension plate 48*c*. In the illustrated embodiment, the first pulleys 54*a*, 54*c* are mounted to bracket 44, while the second pulleys 55*a*, 55*c* are mounted to a rear portion 26*a* of frame 26. The pulleys 54*a*, 54*c* are preferably positioned such that the cables are generally aligned with the direction of translational movement of the collar 42, while the pulleys 55*a*, 55*c* are preferably positioned such that the cables are generally aligned with the direction of translational movement of the ends 49*a*, 49*c* of plates 48*a*, 48*c* when the shaft 38 is rotated to move the collar 42 to adjust the incline of the panels (as can be seen with reference to FIG. 5).

Similar to center panel 22*b* and plate 48*b*, plates 48*a*, 48*c* are attached to the underside of panels 22*a*, 22*c*, respectively, and extend generally downwardly therefrom. The plates 48*a*, 48*c* may be arranged on the panels 22*a*, 22*c* such that generally translational movement of the lower ends 49*a*, 49*c* of the plates 48*a*, 48*c* causes pivotal movement of the respective panels 22*a*, 22*c* about their respective pivot axis 34*a*, 34*c*, such as in a similar manner as discussed above. When collar 42 moves towards second end 38*b* of shaft 38 (such as by rotating the shaft in one direction), cables 50*a* and 50*c* are pulled towards second end 38*b* of shaft 38. This pulling movement causes each of the lower ends 49*a*, 49*c* of extension plates 48*a*, 48*c* to be moved or pulled inwardly towards center area 32 by cables 50*a*, 50*c*. Consequently, the inward movement of the ends 49*a*, 49*c* of the plates 48*a*, 48*c* causes panels 28*a*, 28*c* to be pivoted upwardly to their inclined orientation. Likewise, rotating shaft 38 in the opposite direction causes collar 42 to move in the opposite direction, which allows cables 50*a*, 50*c* to allow the panels 28*a*, 28*c* to pivot downwardly toward their generally horizontal orientation.

The crank 40 may be removably attached to the end of the threaded shaft 38 to allow for adjustment of the panels when desired, and to allow for removal of the crank after such adjustment so that the crank is not in the way of customers at the display stand. After the display stand has been adjusted to the desired angle or orientation, the crank may be readily removed from the end of the threaded shaft and may be stored at an out of sight location on or at the display stand, such as on the underside of the display stand, such as via a clip or fastener or shelf or the like under the display stand for receiving or holding the crank when it is not in use.

The pitch of the threads on the shaft and the collar may be selected to provide a desired amount of pivotal movement of the panels in response to rotation of the shaft and crank. For example, a coarse thread may be used that may substantially move the collar along the shaft via each turn of the shaft such that the panels may be quickly moved between their horizontal and inclined orientations. Alternately, a fine thread may be selected to provide less movement or adjustment of the panels in response to rotation of the shaft (for example, a fine thread may be selected for display stands that may support heavy articles, since less cranking force may be needed to adjust the panels in such an embodiment).

The panels of the display stand of the present invention thus may be angularly or pivotally adjusted about their generally horizontal pivot axes via rotation or cranking of the threaded shaft. In order to adjust the panels of the display stand, a user only has to connect the crank to the end of the threaded shaft and rotate the crank in the desired direction to readily adjust the orientation of all three panels of the display stand to the desired degree of incline. Once the panels are positioned at the desired orientation, the crank may be readily removed from the shaft so that the crank is not in the way of customers at the display rack. When the panels are positioned in the desired degree of incline, the cables continue to pull at the plates to substantially retain the plates and the panels in the desired orientation. When the shaft is rotated to lower the panels to their generally horizontal orientation, the movement of the collar toward the lower or outer end of the shaft allows the cables to be pulled or moved by the weight of the panels as they may move or pivot downwardly via gravitational forces. Optionally, the panels may be biased toward their generally horizontal orientation, such as via a spring or the like, such that when slack is provided in the cables (such as via movement of the collar toward the first end of the threaded shaft), the biasing members may urge the panels toward their horizontal orientation.

While each of the pivotable panels is illustrated in the accompanying drawings as being made of a series of parallel boards 56, it will be understood that other constructions of panels can be used within the scope of the present invention. Further, it would be possible to attach the extension plate of the center panel to a series of pulleys and a cable in a manner similar to the way in which cables 50*a*, 50*c* attach to extension plates 48*a*, 48*c* of panels 22*a*, 22*c*. As another alternative embodiment, it is envisioned that the display stand may be constructed with only two pivotable panels, or with more than three pivotable panels, without affecting the scope of the present invention.

Therefore, the present invention provides an adjustable display stand that is adjustable to correspondingly or substantially simultaneously adjust the degree of tilt or incline of two or more panels via one or more cables and pulleys connected to the panels and an adjustable mechanism. The panels of the display stand may each be pivotable about respective generally horizontal pivot axes at the base of the display stand and may pivot between a generally horizontal position, where the opposed edges of the panels may be generally parallel to and adjacent to one another, and an upwardly angled or tilted or inclined position for displaying products or goods thereon. The arrangement of the shaft and collar and of the pulleys and cables of the height adjustment mechanism allows the height of the panels to be readily adjusted with minimal effort, and to be substantially firmly retained in whatever position they are ultimately adjusted to. All of the panels of the display stand may be adjusted via rotation of a single threaded shaft, such that a user may readily adjust the panels and the overall appearance and function of the display stand via a single crank or the like.

When the shaft is rotated, all of the panels may be adjusted generally in unison, such that each panel may be adjusted or pivoted to generally the same degree of incline as the other panels of the display stand.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the appended claims.

The embodiments of the invention in which an exclusive property or privilege is claimed are defined as follows:

1. An adjustable display stand comprising:

a base;

a first panel having first and second ends, said first end being pivotally mounted to said base and being pivotable about a first generally horizontal pivot axis;

a second panel having first and second ends, said first end of said second panel being pivotally mounted to said base and being pivotable about a second generally horizontal pivot axis; and a height adjustment mechanism mounted to said base, said height adjustment mechanism comprising:

an adjusting member positioned at said base;

a first cable connected to said adjusting member and to said first panel, said first cable being movable around at least one first pulley to pivot said first panel about said first pivot axis to adjust the height of said second end of said first panel relative to said base; and a second cable connected to said adjusting member and to said second panel, said second cable being movable around at least one second pulley to pivot said second panel about said second pivot axis to adjust the height of said second end of said second panel relative to said base, wherein said adjusting member is movable to move said first and second cables substantially simultaneously to correspondingly adjust the incline of said first and second panels relative to said base.

2. The display stand of claim 1, wherein said base includes a plurality of wheels adapted to allow said display stand to be rolled on a floor.

3. The display stand of claim 1, wherein said first and second panels are each shaped to taper from said first end toward said second end.

4. The display stand of claim 3, wherein said first and second panels each include at least one edge that is substantially parallel to and adjacent to each other when said first and second panels are in a generally horizontal orientation.

5. The display stand of claim 4, wherein said first pivot axis is oriented at an angle of at least approximately forty-five degrees with respect to said second pivot axis.

6. The display stand of claim 1, wherein said adjusting member comprises a collar threadedly coupled to an elongated threaded shaft, said first and second cables being attached to said collar, whereby rotation of said shaft causes the position of said collar to change along said shaft to move said cables.

7. The display stand of claim 6 including a crank coupled to said elongated threaded shaft, said crank causing rotation of said shaft to move said cables to pivot said first and second panels when said crank is rotated.

8. The display stand of claim 7, wherein said crank is adapted to be releasably coupled to said height adjustment mechanism.

9. The display stand of claim 6 including a third panel having first and second ends, said first end being pivotally mounted to said base and pivotable about a third generally horizontal pivot axis, said third panel coupled to said collar of said height adjustment mechanism such that said third panel pivots about said third horizontal pivot axis as said collar is moved along said shaft and substantially simultaneously with said first and second panels pivoting about said first and second pivot axes, respectively.

10. The display stand of claim 9, wherein said shaft is pivotally mounted to said base and is pivotable about a generally horizontal pivot axis as said collar is moved along said shaft to pivot said panels.

11. An adjustable display stand adapted to support and display produce in a retail environment, said adjustable display stand comprising:

a base;

a first panel having first and second ends, said first end of said first panel being pivotally mounted to said base and being pivotable about a first generally horizontal pivot axis, said first panel being shaped to taper from said first end toward said second end, said first panel having an attachment member at a lower side thereof;

a second panel having first and second ends, said first end of said second panel being pivotally mounted to said base and being pivotable about a second generally horizontal pivot axis, said second panel being shaped to taper from said first end toward said second end, said second panel having an attachment member at a lower side thereof, opposed edges of said first and second panels being positioned generally parallel to and adjacent to one another when said first and second panels are in a generally horizontal position relative to said base; and a height adjustment mechanism mounted to said base, said height adjustment mechanism comprising:

an elongated threaded shaft rotationally mounted to said base;

a threaded collar threadedly coupled to said threaded shaft and movable along said threaded shaft when said threaded shaft is rotated;

a first cable connected to said collar and to said attachment member of said first panel, said first cable being movable around at least one first pulley to pivot said first panel about said first pivot axis to adjust the height of said second end of said first panel relative to said base, said attachment member of said second panel being attached to said collar, said collar being movable in a first direction to move said first cable and said attachment member of said second panel substantially simultaneously to move said attachment members of said first and second panels to raise said second ends of said first and second panels, said collar being movable in a second direction to move said second ends of said first and second panels toward said base, said second direction being generally opposite to said fast direction.

12. The display stand of claim 11, wherein said base includes a plurality of wheels adapted to allow said display stand to be rolled on a floor.

13. The display stand of claim 11, wherein said shaft is pivotally mounted to said base and is pivotable about a generally horizontal pivot axis as said collar is moved along said shall to pivot said panels.

14. The display stand of claim 11 including a third panel having first and second ends, said first end of said third panel being pivotally mounted to said base and being pivotable about a third generally horizontal pivot axis, said third panel being shaped to taper from said first end toward said second end, said third panel having an attachment member at a lower side thereof, said adjustment mechanism including a second cable attached to said collar and to said attachment member of said third panel.

15. The display stand of claim 14, wherein said first cable is routed around at least one first pulley and said second cable is routed around at least one second pulley, said cables being moved about said pulleys by said collar to pivot said first and third panels about said first and third pivot axes, while said collar moves said attachment member of said second panel to pivot said second panel about said second pivot axis.

16. The display stand of claim 11 including a crank coupled to said elongated threaded shaft, said crank causing rotation of said shaft to move said collar and said cables to pivot said first and second panels when said crank is rotated.

17. The display stand of claim 16, wherein said crank is adapted to be releasably coupled to said height adjustment mechanism.

18. An adjustable display stand adapted to support and display produce in a retail environment, said adjustable display stand comprising:

a base;

a first panel having first and second ends, said first end of said first panel being pivotally mounted to said base and being pivotable about a first generally horizontal pivot axis, said first panel being shaped to taper from said first end toward said second end, said first panel having an attachment member at a lower side thereof;

a second panel having first and second ends, said first end of said second panel being pivotally mounted to said base and being pivotable about a second generally horizontal pivot axis, said second panel being shaped to taper from said first end toward said second end, said second panel having an attachment member at a lower side thereof; and a height adjustment mechanism mounted to said base, said height adjustment mechanism comprising:

an elongated member mounted to said base;

a movable element coupled to said elongated member and movable along said elongated member;

a first cable connected to said movable element and to said attachment member or said first panel, said first cable being movable around at least one first pulley to pivot said first panel about said first pivot axis to adjust the height of said second end of said first panel relative to said base, said attachment member of said second panel being attached to said movable element, said movable element being movable along said elongated member in a first direction to move said first cable and said attachment member of said second panel substantially simultaneously to move said attachment members of said first and second panels to raise said second ends of said first and second panels, said movable element being movable along said elongated member in a second direction to move said second ends of said first and second panels toward said base, said second direction being generally opposite to said first direction.

19. The display stand of claim 18, wherein said base includes a plurality of wheels adapted to allow said display stand to be rolled on a floor.

20. The display stand of claim 18, wherein said elongated member is pivotally mounted to said base and is pivotable about a generally horizontal pivot axis as said movable element is moved along said elongated member to pivot said panels.

21. The display stand of claim 18 including a third panel having first and second ends, said first end of said third panel being pivotally mounted to said base and being pivotable about a third generally horizontal pivot axis, said third panel being shaped to taper from said first end toward said second end, said third panel having an attachment member at a lower side thereof said adjustment mechanism including a second cable attached to said movable clement and to said attachment member of said third panel.

22. The display stand of claim 21, wherein said first cable is routed around at least one first pulley and said second cable is routed around at least one second pulley, said cables being moved about said pulleys by said movable element to pivot said first and third panels about said first and third pivot axes, while said movable element moves said attachment member of said second panel to pivot said second panel about said second pivot axis.

23. The display stand of claim 18, wherein said elongated member comprises a threaded shaft and said movable element comprises a collar that is threadedly coupled to said shaft and movable along said shaft in response to rotation of said shaft.

24. The display stand of claim 23 including a crank coupled to said elongated threaded shaft, said crank causing rotation of said shaft to move said collar and said cable to pivot said first and second panels when said crank is rotated.

25. The display stand of claim 24, wherein said crank is adapted to be releasably coupled to said height adjustment mechanism.

* * * * *

UNITED STATES PATENT AND TRADEMARK OFFICE

CERTIFICATE OF CORRECTION

PATENT NO. : 7,171,909 B2
APPLICATION NO. : 10/797295
DATED : February 6, 2007
INVENTOR(S) : Alt It is certified that error appears in the above-identified patent and that said Letters Patent is hereby corrected as shown below:

Column 8
Claim 11, Line 44, “fast” should be --first--
Claim 13, Line 51, “shall” should be --shaft--

Column 9
Claim 18, Line 34, “or” should be --of--

Column 10
Claim 21, Line 20, insert --,-- after “thereof”
Claim 21, Line 21, “clement” should be --element--

Signed and Sealed this

Twentieth Day of January, 2009

JON W. DUDAS
*Director of the United States Patent and Trademark Office*